US008153054B2

(12) United States Patent
Nazmy et al.

(10) Patent No.: US 8,153,054 B2
(45) Date of Patent: Apr. 10, 2012

(54) HIGH-TEMPERATURE ALLOY

(75) Inventors: Mohamed Nazmy, Fislisbach (CH); Andreas Künzler, Baden (CH); Giuseppe Bandiera, Ehrendingen (CH); Hanspeter Zinn, Rütihof (CH)

(73) Assignee: Alstom Technology Ltd, Baden (CH)

( * ) Notice: Subject to any disclaimer, the term of this patent is extended or adjusted under 35 U.S.C. 154(b) by 321 days.

(21) Appl. No.: 12/509,076

(22) Filed: Jul. 24, 2009

(65) Prior Publication Data

US 2010/0021338 A1 Jan. 28, 2010

(30) Foreign Application Priority Data

Jul. 25, 2008 (CH) ..... 1174/08

(51) Int. Cl.
*C22C 38/26* (2006.01)
*C22C 38/22* (2006.01)

(52) U.S. Cl. ..... 420/40; 420/63; 420/68; 420/69; 420/79; 420/81

(58) Field of Classification Search ..... 420/40, 420/63, 68, 69, 79, 81; 148/325, 592, 593, 148/648; 75/246
See application file for complete search history.

(56) References Cited

U.S. PATENT DOCUMENTS 3,746,581 A * 7/1973 Cairns et al. ..... 75/246
4,277,374 A * 7/1981 Lula et al. ..... 502/185
4,334,923 A * 6/1982 Sherman ..... 420/77
5,286,442 A 2/1994 Uematsu et al.
5,939,204 A * 8/1999 Czech ..... 428/469
6,499,943 B1 * 12/2002 Beeck et al. ..... 415/115
2003/0089198 A1 5/2003 Berglund et al.
2008/0210348 A1 9/2008 Goransson et al.

FOREIGN PATENT DOCUMENTS

DE 199 41 228 A1 3/2001
EP 0 516 267 A1 12/1992
EP 0573343 A1 * 12/1993
EP 1 076 157 A2 2/2001
WO WO 01/49441 A1 7/2001
WO WO 2005/080622 A1 9/2005

OTHER PUBLICATIONS

Switzerland Search Report (PCT/ISA/201) dated Jul. 25, 2008.

* cited by examiner

*Primary Examiner* — Deborah Yee

(74) *Attorney, Agent, or Firm* — Buchanan Ingersoll & Rooney PC

(57) ABSTRACT

An iron-based high-temperature alloy is disclosed which contains the following chemical composition: 20% by weight Cr; 5 to 6% by weight Al; 4% by weight Ta; 4% by weight Mo; 3 to 4% by weight Re; 0.2% by weight Zr; 0.05% by weight B; 0.1% by weight Y; 0.1% by weight Hf; 0 to 0.05% by weight C; and remainder Fe and unavoidable impurities. The alloy can be produced at low cost and can possess outstanding oxidation resistance and good mechanical properties at temperatures up to 1200° C.

5 Claims, 1 Drawing Sheet

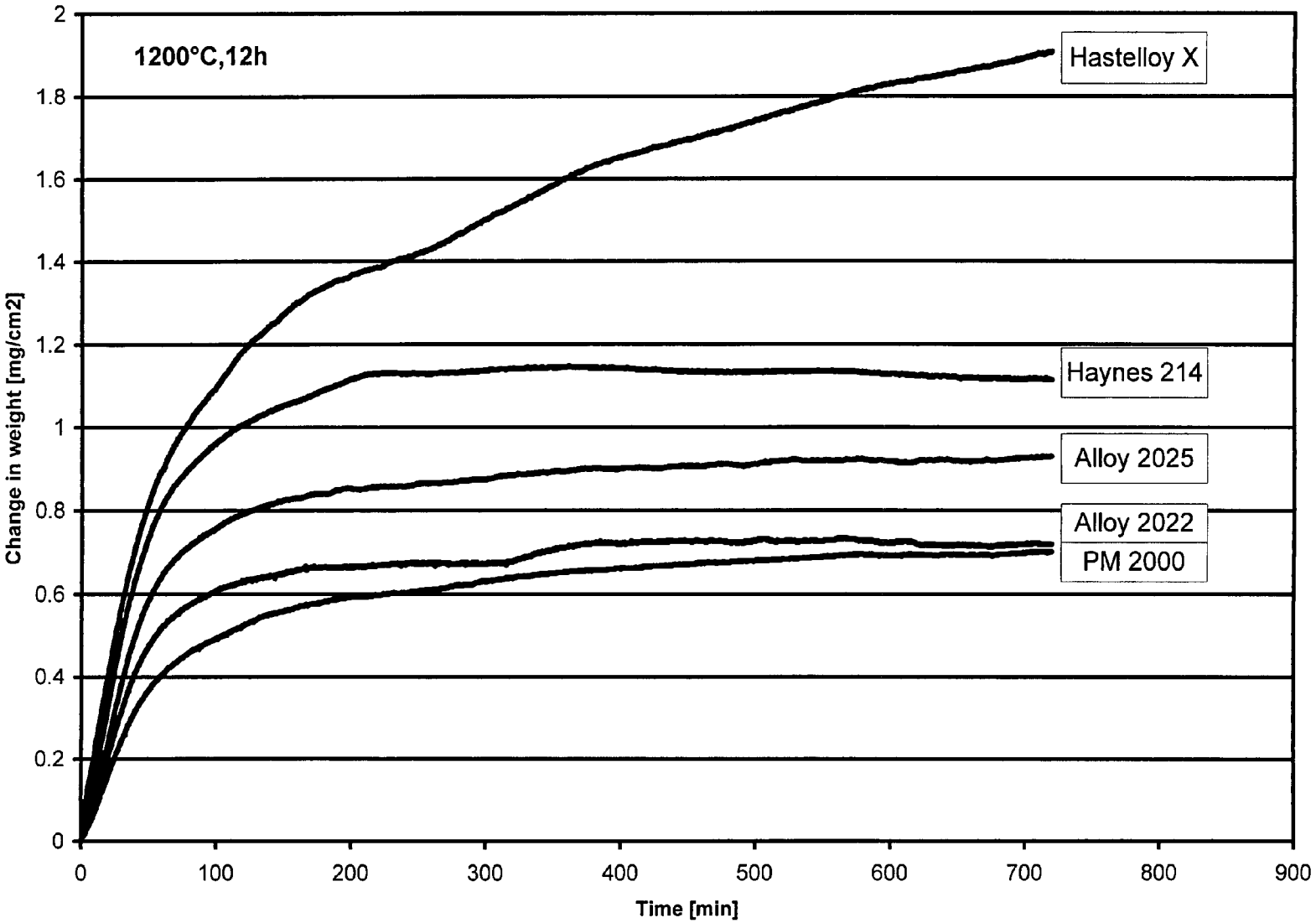
1200°C,12h
Hastelloy X
Haynes 214
Alloy 2025
Alloy 2022
PM 2000
Change in weight [mg/cm2]
Time [min]
0
0.2
0.4
0.6
0.8
1
1.2
1.4
1.6
1.8
2
0
100
200
300
400
500
600
700
800
900

HIGH-TEMPERATURE ALLOY

RELATED APPLICATION

This application claims priority under 35 U.S.C. §119 to Swiss Patent No. 01174/08 filed in Switzerland on Jul. 25, 2008, the entire content of which is hereby incorporated by reference in its entirety.

FIELD

The disclosure concerns the field of materials science. It relates to an iron-based high-temperature alloy which, for example, contains approximately 20% by weight Cr and several % by weight Al, as well as small amounts of other constituents, and which can possess good mechanical properties and oxidation resistance at operating temperatures up to 1200° C.

BACKGROUND INFORMATION

Iron-based ODS (oxide-dispersion-strengthened) materials, for example ferritic ODS FeCrAl alloys, have been known for some time. On account of their outstanding mechanical properties at high temperatures, they are, for example, used for components that are subjected to extreme thermal and mechanical stress, such as gas turbine blades or vanes.

These materials can also be used for tubes to protect thermocouples which are used, for example, in gas turbines with sequential combustion for temperature control and are exposed to extremely high temperatures and oxidizing atmospheres.

Table 1 specifies nominal chemical compositions (in % by weight) of known ferritic iron-based ODS alloys:

TABLE 1

Nominal composition of known ODS-FeCrAlTi alloys

| Alloy designation | Constituent Fe | Cr | Al | Ti | Si | Addition of reactive elements (in the form of an oxide dispersion) |
|---|---|---|---|---|---|---|
| Kanthal APM | Rem. | 20.0 | 5.5 | 0.03 | 0.23 | $ZrO_2$—$Al_2O_3$ |
| MA 956 | Rem. | 20.0 | 4.5 | 0.5 | — | $Y_2O_3$—$Al_2O_3$ (0.5 $Y_2O_3$) |
| PM 2000 | Rem. | 19.0 | 5.5 | 0.5 | — | $Y_2O_3$—$Al_2O_3$ (0.5 $Y_2O_3$) |

The operating temperatures of these metallic materials reach up to, for example, approximately 1350° C. They have potential properties that are more typical of ceramic materials.

The materials mentioned can have very high creep rupture strengths at very high temperatures and can also provide outstanding high-temperature oxidation resistance by forming a protective $Al_2O_3$ film, as well as a high resistance to sulfidizing and vapor oxidation. They can have highly pronounced directional-dependent properties. For example, in tubes, the creep strength in the transverse direction is approximately 50% of the creep strength in the longitudinal direction.

ODS alloys of this type are produced by powder metallurgical processes, using mechanically alloyed powder mixtures that are compacted in a known way, for example by extrusion or by hot isostatic pressing. The compact is subsequently highly plastically deformed, usually by hot rolling, and subjected to a recrystallization annealing treatment. This type of production, but also the material compositions described, results in, inter alia, these alloys being very expensive and having anisotropic properties.

Furthermore, various Ni-based wrought alloys such as, for example, Hastelloy X and Haynes 214 are known, and can be produced at a lower cost than the materials mentioned above and do not have anisotropic properties. These alloys have the following chemical compositions:

TABLE 2

Nominal composition of known Ni-based wrought alloys

| Alloy designation | Constituent Ni | Cr | Co | Mo | W | Fe | Mn | Si | C | Al | Y |
|---|---|---|---|---|---|---|---|---|---|---|---|
| Hastelloy X | Rem. | 22 | 1.5 | 9 | 0.6 | 18.5 | 0.5 | 0.5 | 0.1 | 0.3 | — |
| Haynes 214 | Rem. | 16 | — | — | — | 3 | — | — | 0.04 | 4.5 | 0.01 |

According to the company brochure, the material Haynes 214 should be the most oxidation-, carburization- and chlorination-resistant alloy commercially available as a wrought alloy, with effective use being possible at 2200° F. (approximately 1205° C.) for long-term stress and at 2400° F. (approximately 1316° C.) for short-term stress. However, properties of this alloy at very high temperatures are not as good as the outstanding properties of the ODS alloys mentioned above.

SUMMARY

An iron-based high-temperature alloy chemical composition is disclosed, comprising (e.g. consisting of):

20% by weight Cr;

5 to 6% by weight Al;

4% by weight Ta;

4% by weight Mo;

3 to 4% by weight Re;

0.2% by weight Zr;

0.05% by weight B;

0.1% by weight Y;

0.1% by weight Hf;

0 to 0.05% by weight C;

and remainder Fe and impurities.

A method is disclosed for producing a high-temperature alloy containing:

20% by weight Cr;

5 to 6% by weight Al;

4% by weight Ta;

4% by weight Mo;

3 to 4% by weight Re;

0.2% by weight Zr;

0.05% by weight B;

0.1% by weight Y; 0.1% by weight Hf;

0 to 0.05% by weight C;

and remainder Fe and impurities, the method comprising: melting elements corresponding to the alloy chemical composition by an arc; and rolling the alloy chemical at approximately 900-800° C.

BRIEF DESCRIPTION OF THE DRAWINGS

Exemplary embodiments of the disclosure are discussed with respect to the drawing.

The single FIGURE shows oxidation behavior at 1200° C./12 h for two high-temperature alloys according to the disclosure as compared with the known alloys PM 2000, Hastelloy X and Haynes 214.

The disclosure is explained in more detail below on the basis of exemplary embodiments and the drawing.

DETAILED DESCRIPTION

Exemplary embodiments as disclosed herein are directed to developing an iron-based material that is suitable for various applications (such as protective tubes for thermocouples which can be used at extremely high temperatures in gas turbines), and costs less than the known PM 2000 material, but has at least equally good oxidation resistance. Exemplary material according to the disclosure can be well-suited for hot working and have very good mechanical properties.

An exemplary high-temperature alloy of the FeCrAl type disclosed herein can have a chemical composition which contains (e.g., consists of):

20% by weight Cr;
5 to 6% by weight Al;
4% by weight Ta;
4% by weight Mo;
3 to 4% by weight Re;
0.2% by weight Zr;
0.05% by weight B;
0.1% by weight Y;
0.1% by weight Hf;
0 to 0.05% by weight C; and
remainder Fe and impurities (e.g., unavoidable impurities).

Exemplary compositions as disclosed herein can consist of any one or more of the above elements in the percentages by weight listed, including any specific percentage by weight which falls within a range specified for any given element. All percentages by weight specified herein are approximate (e.g., ±10%).

The high Cr content (e.g., 20% by weight) can ensure that the material has a good oxidation and corrosion behavior. Cr can also have a positive effect on the ductility.

The alloy contains about 5-6 (e.g., preferably 5.5%) by weight Al. This forms a protective $Al_2O_3$ film on the surface of the material, which can increase the high-temperature oxidation resistance.

If the Ta and Mo contents are lower than the values of 4% by weight specified for each, the high-temperature strength can be reduced too much; if they are higher, the oxidation resistance can be reduced in an undesirable manner and the material also becomes too expensive.

It has surprisingly been found that it is not necessary, as is the case with the known ODS alloys and described above, to add titanium. Ti and Cr act as solid-solution strengtheners. In the range of about 4% by weight, Mo has a similar effect but is much less expensive than Ti. In addition, if it is added together with Zr, as is the case in the present disclosure, Mo leads to improved tensile strengths and creep rupture strengths.

Ta, Zr and B are elements that act as dispersion strengtheners. The interaction of these constituents with the other constituents (e.g., the Cr, the Mo and the Ta) can lead to good strength values, while Al, Y and also Zr and Hf increase the oxidation resistance. Cr can have a positive effect on the ductility.

Rhenium can be particularly important. The addition of about 3-4% by weight Re can, for example, improve the creep rupture strength of the material at very high temperatures but, at the same time, also increases the oxidation resistance. Re is a solid-solution strengthener and can have a very strong effect in improving the creep properties at high temperatures. It can increase the activity of Al to form $Al_2O_3$.

Re has a hexagonally tightly packed crystal structure that differs greatly from the cubic lattice structure of Fe, Mo, Al, Ta, Cr. This difference in the crystal structure of Re means that it acts as a solid-solution strengthener.

On account of its chemical composition (e.g., combination of the specified elements in the specified ranges), the material according to the disclosure can have outstanding properties at temperatures of 1200° C. (e.g., a good creep rupture strength and extremely high oxidation resistance).

Known alloys (ODS FeCrAl comparative alloy PM 2000 produced by powder metallurgical means, as well as the wrought alloys Hastelloy X and Haynes 214—see table 2 for the composition) and the alloys according to the disclosure listed in table 3 were investigated with regard to the oxidation behavior at very high temperatures, in this case 1200° C. The alloying constituents of the alloys 2025 and 2022 according to the disclosure are specified in % by weight:

TABLE 3

Compositions of the investigated alloys according to the disclosure

| Alloy | Constituent | | | | | | | | | | |
|---|---|---|---|---|---|---|---|---|---|---|---|
| designation | Fe | Cr | Al | Ta | Mo | Re | Zr | B | Y | Hf | C |
| 2022 | Rem. | 20 | 5.5 | 4 | 4 | 4 | 0.2 | 0.05 | 0.1 | 0.1 | — |
| 2025 | Rem. | 20 | 5.5 | 4 | 4 | 3 | 0.2 | 0.05 | 0.1 | 0.1 | 0.05 |

Exemplary alloys according to the disclosure were produced by arc melting of the elements specified and then rolled at temperatures of 900-800° C. Specimens for determining the oxidation resistance and the mechanical properties were produced therefrom.

In the single FIGURE, the change in weight at 1200° C. is represented as a function of time over a time period of 12 hours for the alloys specified. As expected, the very costly known comparative alloy PM 2000, produced by a powder metallurgical process, shows the smallest changes in weight, and therefore the best oxidation resistance, under these test conditions. A virtually equally good progression of this property is also shown by the alloy 2022 according to the disclosure, this alloy differing from the other alloy 2025 according to the disclosure merely in that it contains no carbon and has a 1% by weight higher Re content. Under the test conditions mentioned above, the oxidation behavior of the other known investigated wrought alloys (Hastelloy X and Haynes 214) is much worse than that of the alloys according to the disclosure. By way of example, the change in weight of the Hastelloy specimens can be approximately 2-2.5 times greater than that of the alloys according to the disclosure after age-hardening for 12 hours at 1200° C.

For exemplary alloys according to the disclosure, the yield strength at 1000° C. is approximately 60 MPa, whereas the comparative alloy PM 2000 has a yield strength at 1000° C. of approximately 90 MPa. However, if this is considered in conjunction with the outstanding oxidation behavior of these alloys at 1200° C. (see FIGURE), this represents a very good combination of properties. The lower strength of the alloys according to the disclosure as compared with PM 2000 is additionally entirely sufficient for the intended purpose (protective tube for a sheathed thermocouple).

The materials according to the disclosure are, for example, also well-suited for hot rolling and have good plastic deformability.

It is clear that a combination of Mo and Ta in equal amounts can have, for example, good effect on the oxidation behavior at 1200° C. In the range specified, Ta, for example, can increase the activity of Al and improve the oxidation resistance.

Protective tubes for sheathed thermocouples can be advantageously produced from exemplary materials according to the disclosure. Thermocouples of this type are used, for example, in gas turbines with sequential combustion for temperature control and are exposed there to oxidizing atmospheres.

Exemplary alloys according to the disclosure can have very high oxidation resistance at 1200° C. Although the strength values of the alloys according to the disclosure can be somewhat lower than those of the alloy PM 2000 at high temperatures, they are still sufficiently high. Since exemplary alloys according to the disclosure can be less expensive than PM 2000 (less expensive constituents, simpler production), they are outstandingly suitable as a substitute for PM 2000 for the areas of use described above.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An iron-based high-temperature alloy chemical composition, consisting of:

20% by weight Cr;
5 to 6% by weight Al;
4% by weight Ta;
4% by weight Mo;
3 to 4% by weight Re;
0.2% by weight Zr;
0.05% by weight B;
0.1% by weight Y;
0.1% by weight Hf;
0 to 0.05% by weight C; and
remainder Fe and impurities.

2. The high-temperature alloy as claimed in claim 1, wherein the Al content is 5.5% by weight.

3. The high-temperature alloy as claimed in claim 2, wherein the C content is 0.05% by weight.

4. The high-temperature alloy as claimed in claim 3, wherein the Re content is 3% by weight.

5. The high-temperature alloy as claimed in claim 2, wherein the Re content is 4% by weight.

* * * * *